United States Patent [19]

Kress

[11] Patent Number: 4,821,415

[45] Date of Patent: Apr. 18, 1989

[54] CONVERSION SET FOR A PORTABLE CIRCULAR SAW

[75] Inventor: Willy Kress, Bisingen, Fed. Rep. of Germany

[73] Assignee: Kress-elektrik GmbH & Co., Bisingen, Fed. Rep. of Germany

[21] Appl. No.: 164,124

[22] Filed: Mar. 4, 1988

[30] Foreign Application Priority Data

Feb. 18, 1988 [DE] Fed. Rep. of Germany ..... 3805041

[51] Int. Cl.[4] ..... B25F 3/00

[52] U.S. Cl. ..... 30/122; 30/383; 30/500

[58] Field of Search ..... 30/122, 383, 386, 500

[56] References Cited

U.S. PATENT DOCUMENTS 2,839,097 6/1958 Siria ..... 30/122
2,860,671 11/1958 Wilden ..... 30/122
2,879,814 3/1959 Scott ..... 30/122
4,649,644 3/1987 Anddleston ..... 30/122

*Primary Examiner*—Frank T. Yost
*Assistant Examiner*—Willman Fridie, Jr.
*Attorney, Agent, or Firm*—Paul Fields

[57] ABSTRACT

In connection with a conversion set for a portable circular saw, which latter comprises a housing, an associated electric drive motor with output shaft and, if necessary, also a gear, and at least one handle, it is proposed to attach to the basic unit remaining after removal of the circular saw blade a chain-saw adapter attachment, to convert the portable circular saw in this manner into an electric chain saw and to secure the chain-saw adapter attachment in place by means of mechanical stops provided on a main bearing plate and coacting with the gear housing of the circular saw and, in the axial direction, by tightening a screw upon the output shaft of the circular saw projecting through the drive pinion for the saw chain.

13 Claims, 3 Drawing Sheets

CONVERSION SET FOR A PORTABLE CIRCULAR SAW

BACKGROUND OF THE INVENTION

The present invention relates to a conversion set for a portable circular saw according to the preamble of claim 1.

Portable circular saws of the usual type, for example applicant's Kress saw model 6050/55 which is particularly well suited for the purposes of the present invention, comprise a housing accommodating an electric drive motor and in some cases also the latter's gear. The power of the electric motor of such saws is relatively high, compared with other usual electric hand tools, for example in the range of 1 kW. The housing comprises further handles for guiding the portable hand saw, the longitudinal axis of the driving electric motor extending transversely to the cutting direction of the portable hand saw so that the circular saw blade can be mounted on the output shaft end to rotate therewith and can be secured thereon in a suitable manner, usually by a locking screw of suitable shape and structure, without the use of a direction-change gear. The overall shape of such a portable circular saw normally tapers in downward direction and ends in a foot or base which can be adjusted as regards its distance to the housing whereby the cutting depth of the portable circular saw is varied—this adjustment being normally made on one side only—and which in addition can be inclined at pre-determined angles so as to permit the execution of angular cuts. In addition, it is possible by means of the foot or corresponding guide means provided on the housing to use different rip fences so that defined cuts are rendered possible. Portable circular saws of this type are suited for sawing boards or the like it being however rarely possible to achieve a cutting depth in excess of 20 to maximally 30 mm.

On the other hand, there are known in the art chain saws of many shapes and designs, for example in the form of power saws driven by a combustion engine or in the form of electric chain saws which provide the combined advantage of smoother operation and easier handling so that such electric chain saws have found acceptance not only in industrial applications, but also, and in particular, in the private area, for example for preparing firewood, for cutting larger trees, and the like.

For converting electric hand tools for different applications a great number of adapter systems, and the like, have been known. According to one of these systems, a motor of a given power is equipped with a suitable mounting surface which can be attached to, for example clicked in place on, different tool attachments or adapter arrangements so that a plurality of individual tools can be driven by a single electric motor.

The possibility to convert a portable circular saw into an electric chain saw has never been seen before, and this in the first line because a portable circular saw comprises a plurality of safety features, mainly due to the relatively high risk of injuries connected with its handling, for example a full-size rigid upper blade guard fixed to the housing and an additional pivoting safety guard which covers the lower part of the saw blade in its inoperative position and is progressively pivoted to the rear as the saw advances through the material to be cut. In addition, electric chain saws differ considerably from portable circular saws as regards their basic shape. An electric chain saw comprises, for example, a guide bar projecting horizontally and transversely from its forward end and serving as a guide for the chain. In the case of a portable circular saw, this area is provided with a full-size and rigid enclosure so that a conversion between these two types of saws would seem impossible already for this reason. When tools are to be converted, i.e. changed over from one form to another form, one has to consider in addition that the required conversion work must not be too complicated for private people because otherwise they would rather not use the conversion set and, in the present case, not use a dual-saws chain saw, but prefer to do completely without the chain saw attachment or to use two separate systems, at considerably higher cost. Also, it is of importance in this connection that the machine obtained after conversion must not be too different from the usual form of such a machine, in the present case a chain saw, and must be fully serviceable while meeting at least the same safety standards as other electric chain saws.

Now, it is the novel object of the present invention to provide a conversion set for a portable circular saw which permits the latter to be converted with the least possible effort into an electric chain saw with perfect and precise handling properties.

ADVANTAGES OF THE INVENTION

The conversion set according to the invention solves this problem by the characterizing features of the main claim and provides the advantage that the conversion of the usual portable circular saw into an electric chain saw is a matter of seconds and that the electric chain saw resulting from this conversion meets the same safety standards which are normally met by electric chain saws.

Another advantage of the invention is seen in the fact that the basic unit of the portable circular saw need not be disassembled for carrying out the conversion. Rather, it is only necessary to remove the circular saw blade whereby the only screw required for carrying out the conversion, i.e. the locking screw of the circular saw blade, becomes available. One then only has to attach the chain saw adapter attachment to the portable circular saw which remained completely unchanged, to slide the chain pinion over the output shaft and to retighten the screw again. The conversion is now completed and the electric chain saw is in serviceable condition, it being an additional advantage compared with usual electric chain saws that the saw base of the portable circular saw is incorporated unchanged into the new machine.

This provides the possibility to carry out angular cuts at angles of up to 45° as the adjusting properties of the saw base of the portable circular saw remain unimpaired. In addition, the saw base of the portable circular saw may be used to form a rip fence. The cutting depth of the chain saw is limited only by the length of the guide bar of the chain saw. This novel possibility to carry out defined cuts opens up additional applications for a dual-purpose saw without impairing, however, the possibility to use it for the usual applications, for example for preparing firewood, for cutting and felling trees, etc.

An additional advantage is seen in the fact that the chain saw adapter attachment carries all the components and parts necessary for the operation of the chain saw, including an oil tank and the corresponding means to ensure perfect lubrication of the chain saw and perfect sliding properties between the latter and the guide bar.

Further, it is of advantage that the usual pivoting safety guard is also not removed during conversion, but only pushed to the rear. The guide bar as the main component of the new electric chain saw is inserted and secured in place by mechanical stops, whereafter it is necessary only to fix the entire adapter attachment in the axial direction, as mentioned before, by tightening the shaft screw.

The features described in the sub-claims provide advantageous further developments and improvements of the conversion set defined in the main claim. Particularly advantageous conditions are obtained when the adapter attachment for the chain saw is designed in the form of a main bearing plate facing the basic unit of the portable circular saw and carrying at the same time the mechanical fixing or locking means as well as the chain pinion which is driven by the output shaft of the portable circular saw as well as the guide bar. At a certain distance from this main bearing plate there is provided a cover plate which either supports, or is formed integrally with, the oil tank and which serves to cover the parts in the area of the drive pinion so that, just as in the case of other electric chain saws, only the working area of the saw chain on the guide bar is exposed. The operating safety of the structure of the electric chain saw may be further improved by a rear safety driving knife.

BRIEF DESCRIPTION OF THE DRAWING

One embodiment of the invention will be described hereafter with reference to the drawing in which.

DESCRIPTION OF THE EMBODIMENTS

It is the basic idea of the present invention that a portable circular saw can be converted into an electrically driven chain saw by mounting the pinion driving the chain saw directly on the output shaft of the portable circular saw, which normally carries the circular saw blade, and fixing it in this position by a screw, whereby a main bearing plate seating the pinion assumes a position fixed against rotation relative to the housing of the portable circular saw.

Figure 1:
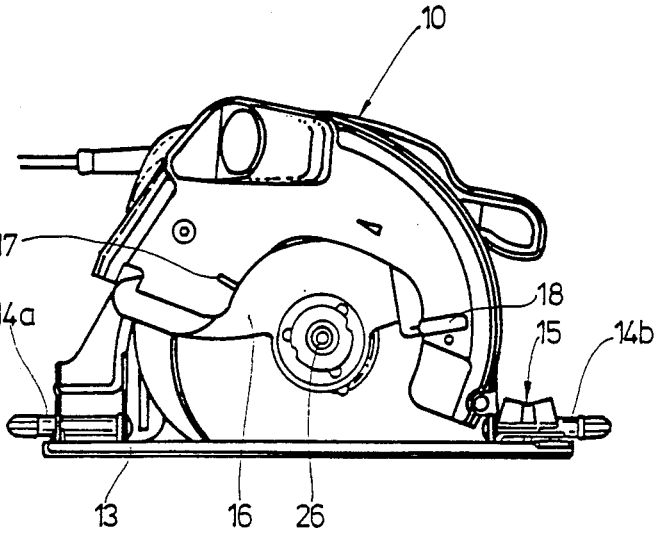
FIG. 1 shows a side view of a usual portable circular saw, with saw base and rearwardly pivoted safety guard.

The portable circular saw 10 shown in FIG. 1 comprises an electric drive motor—not shown in this view—normally driving the circular saw blade—not shown in the drawing—, the latter being held in position on the output shaft of the gear by means of flanges and/or spacer discs provided on both sides of the saw blade, and a locking nut 41. The basic structure of such a manual circular saw is completed by a saw base 13 with adjusting means 14*a*, 14*b* provided on both sides for varying the cutting depth, carrying out angular cuts and/or for receiving a rip fence shown at 15, and further by a usual pivoting safety guard which in the representation of FIG. 1 has been retracted into contact with a stop formed by a longitudinal projection 17, and finally a small handle 18 enabling the pivoting safety guard to be pivoted manually by the operator.

Such a usual portable circular saw 10, as shown in FIG. 1, forms the original unit which is to be converted into an electric chain saw. To this end, only the saw blade, which is held in position by the screw 12, has to be removed—an operation which can be, and often has to be, carried out by any user of a portable circular saw, for example when the saw blade has to be ground or when a different tooth shape is required, etc.

Figure 2:
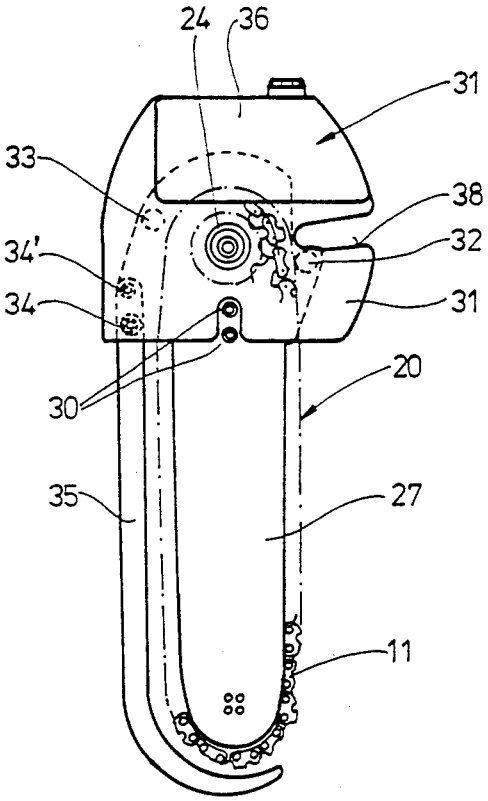
FIG. 2 shows, a front view of the chain saw adapter attachment, the cover plate being deliberately represented as transparent.

The chain saw adapter attachment to be connected to the portable circular saw 10 in FIG. 1 is represented in FIG. 2 and designated by reference numeral 20. The adapter attachment 20 comprises as an essential component a base plate or main bearing plate 21 (see FIG. 3) which carries the pinion 24 driving the saw chain 11 via a bearing 23 seated in a central bore 22. After removal of the circular saw blade, the (integrally formed) mounting spindle 24' of the pinion is seated on the shaft end 26 of the portable circular saw 10. The mounting spindle may be provided with an internal flat driving surface to fix the pinion on the output shaft against rotation.

This completes the operations necessary for fixing the chain saw adapter attachment. Fixing the adapter attachment at the housing/motor/gear of the circular saw is realized by stop/locking or safety means not shown in the drawing which project from the main bearing plate and get into form-locking engagement with matching parts of the portable circular saw, preferably the gear housing adjacent the adapter attachment. The locking means serving to secure the basic unit of the portable circular saw on the one hand and the adapter attachment on the other hand against rotation relative to each other are not shown in the drawing, also because in principle they may be given any desired design, structure and shape and because they must of course be adapted to the respective type of portable circular saw.

Figure 3:
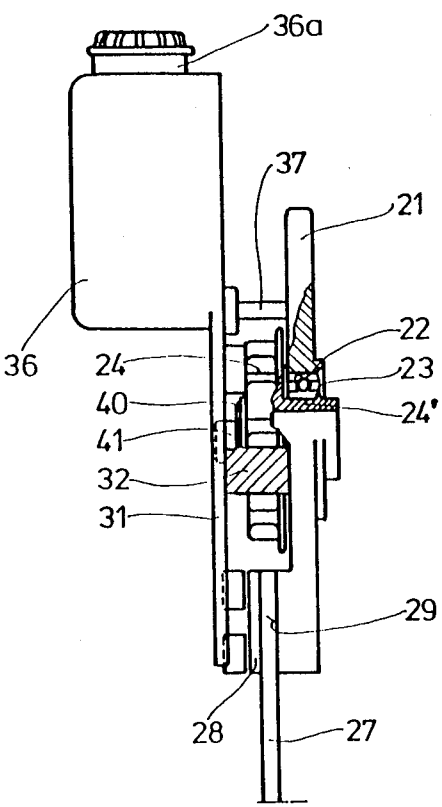
FIG. 3 shows an enlarged and partially cut partial side view of the chain saw adapter attachment.
Figure 5:
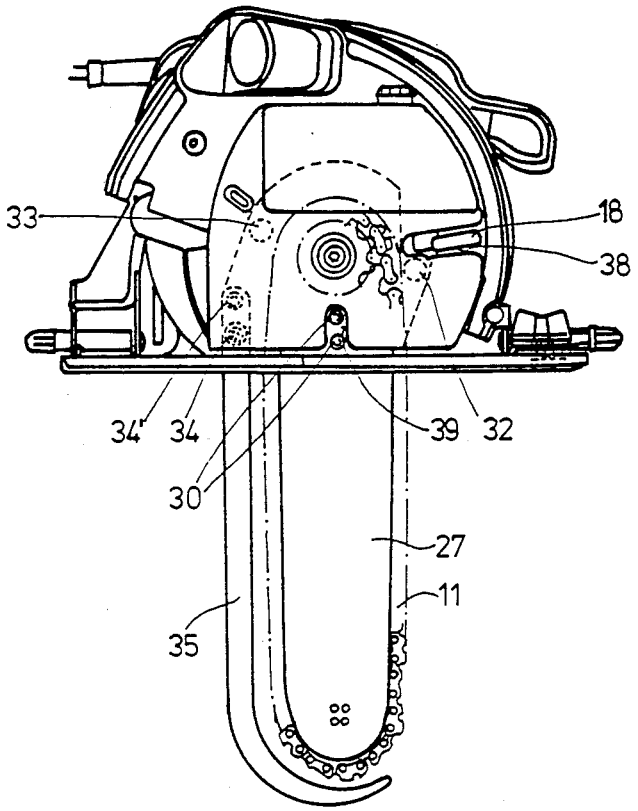
FIG. 5 shows the portable circular saw after conversion into a chain saw (dual-purpose saw).

In the case of the preferred embodiment of the invention, where the chain saw adapter attachment is attached to a portable circular saw make Kress, type 6050/55, a first angle plate or angle (not shown in the drawing) is provided on the rear face of the main bearing plate in a position projecting to the right—viewed in the drawing plane of the representation of FIG. 3. This angle, which may be formed integrally with the main bearing plate, or may be connected to the latter in a suitable manner, for example by means of screws, projects towards the adjacent parts of the portable circular saw so that the unit is supported and secured against rotation, with the gear housing serving as a stop.

Preferably, a second, downwardly inclined angle (not shown in the drawing) may be provided which then forms together with the first angle the general shape of a U whereby the gear housing is supported also on its other side. The locking means are then positioned between the gear housing of the portable circular saw and the saw base 13, securing in this manner the main bearing plate and, thus, the entire adapter attachment, the main bearing plate being made from aluminium of suitable thickness.

The main bearing plate 21 also carries the guide bar 27 of the chain which is fixed to a lower leg 28 projecting to the left in the drawing plane of FIG. 3. The leg 28 may comprise an opening 29 receiving the guide bar 27. The guide bar is then inserted into this opening and fixed in place, for example, by means of two screws 30 which may be guided in longitudinal holes in the guide bar for the purpose of adjusting the guide bar in the longitudinal direction and tensioning the chain.

A cover plate 31 arranged at a certain distance from the main bearing plate 21 is fixed to the latter by spacer means, for example spacer pins determining at the same time the distance between the cover plate and the main bearing plate. There may be provided, for example, three spacer pins or other spacer elements, consisting of a chain-catcher bolt 32, a locking or retaining pin 33 and another spacer pin 34, the chain-catcher bolt 32 and the other spacer pin 34 serving dual functions. As is indicated already by its name, the chain-catcher bolt also serves to catch the chain in case of failure so that the chain winds around the pin and is prevented from breaking clear to the outside, while the other spacer pin 34 serves simultaneously as one of the two bolts 34, 34' holding and fixing the safety driving knife 35 between the main bearing plate 21 and the cover plate 31.

The cover plate 31 carries in addition the oil tank 36 with its upper filling pipe **36*a* required for lubricating the saw chain, the pinion and the sliding surfaces of the guide bar. The oil tank 36 may be fixed to the cover plate 31 in a suitable manner, or may be united with the cover plate 31** to a single part—as in the embodiment shown—for example by welding.

Figure 4:
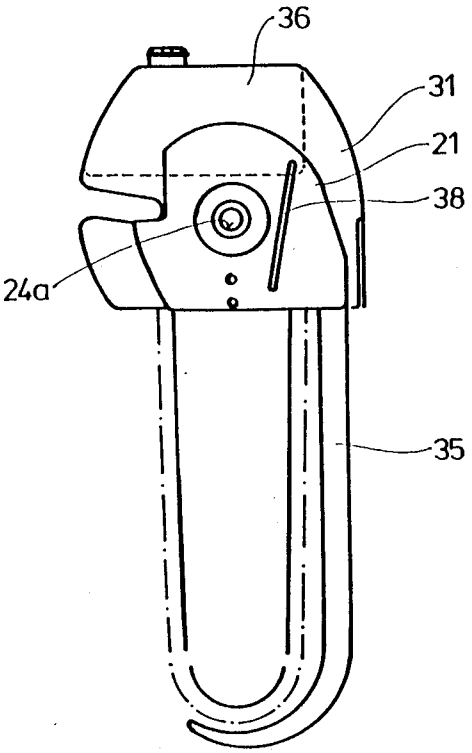
FIG. 4 shows rear view of the chain saw adapter attachment.

Considering that the cover plate 31 must be detachable from the main bearing plate 21 to provide access to the saw chain and the drive means located at this point, for example for the purpose of exchanging the saw chain or removing it for grinding, the spacer elements between the main bearing plate 21 and the cover plate 31 are designed as detachable screw connections, and a drop tube 37 is required for guiding and transporting the oil for the oiler. The drop tube is fixed to the main bearing plate 21 and extends inside a groove 38—which can be seen best in the rear view of FIG. 4—in the main bearing plate, then forwardly in the upper area—see FIG. 3—towards the tank where it can be introduced into a tank discharge opening sealed by means of an O ring. At the lower end of the groove 38, the drop tube is then guided again to the outside, through the main bearing plate, where its opening is directly directed upon the chain guide and the chain driver. The oil flow is determined by suitable throttle means (not shown in the drawing) in conjunction with the viscosity of the oil.

From the representation of FIG. 2, in particular, it appears that the front cover plate 31 arranged opposite the basic unit of the portable circular saw has a larger surface, compared with the main bearing plate, so that it also covers the adjacent area, i.e. the free area in the basic unit of the circular-saw reserved for the circular saw blade, and accommodates in addition the small hand lever 18 of the pivoting safety guard in a small lateral slot 38 so that the pivoting safety guard remains locked in the retracted position after conversion of the unit into an electric chain saw.

In order to enable the position of the guide bar to be adjusted by operation of the screws 30 without removing the front cover plate 31, the latter is further provided with a marginal recess 39 in the area of these screws.

According to the preferred embodiment of the invention, a mounting spindle 24' formed integrally with the pinion 24 is seated in the receiving opening of the inner race of the ball bearing 23 arranged in the bore 22 of the main bearing plate 21. The mounting spindle 24' is provided with an inner flat driving surface **24*a* (see FIG. 4**) by which it is fitted on the output shaft of the gear.

The guide bar 27 is provided on its end opposite the driving pinion 24 with a direction-change gear not separately shown in the drawing.

This structure of the chain-saw adapter attachment can be mounted extremely easily on the base unit of a usual portable circular saw. To this end, the saw base is first adjusted to a small cutting depth (stop) after the circular saw blade has been removed, whereafter the pivoting safety guard is pushed back and the adapter attachment, including the guide bar, is inserted from the top and pressed against the gear housing of the circular saw, whereby the output shaft of the gear is simultaneously passed through the mounting spindle 24' of the drive pinion. Then a spacer 40 (see FIG. 3) is fitted on the shaft end which now freely projects on the other side of the pinion 40, whereafter the locking screw 41, which is represented only partly in this figure, is mounted and tightened. This completes the conversion of the portable circular saw into an electric chain saw which is now ready for operation.

All features mentioned or shown in the above description, the following claims and the drawing may be essential to the invention either alone or in any combination thereof.

I claim:

1. Conversion set for a portable circular saw including a housing, an electric drive motor mounted within the housing, a saw blade output mounting shaft in driving connection with the motor and having an end extending from said housing, the improvement comprising a chain-saw adaptor attachment adapted to be connected to said portable circular saw, the said adaptor attachment having a self-supporting main bearing plate non-rotatably attached to said portable circular saw and being oriented in a plane vertical to said output mounting shaft, and a pinion seated in the said main bearing plate for driving a saw chain connected thereto and connected with said output mounting shaft, said main bearing plate (21) comprising a bore (22) having bearing therein (ball bearing 23) and ,receiving a mounting spindle in said bearing (24'), said spindle being connected to the said pinion (24), the said mounting spindle (24') being fitted on the said output mounting shaft of the said basic unit (10) of the portable circular saw for rotationally entraining the said pinion (24).

2. Conversion set according to claim 1, and a screw is screwed upon the output mounting shaft end and providing the sole means for fixing the said adaptor attachment in the axial direction.

3. Conversion set according to claim 2, characterized in that the said main bearing plate (21) of the said chain saw adaptor attachment (20) is secured against rotation by stops co-acting mechanically with the housing of the said portable circular saw.

4. Conversion set according to claim 3, characterized in that the said stops securing the said main bearing plate (21) against rotation are formed by at least one angle plate projecting towards the housing of the said portable circular saw.

5. Conversion set according to claim 4, and a guide bar and a cover plate carried by said main bearing plate (2I).

6. Conversion set according to claim 4, characterized in that the second angle plate is fixed on the said main bearing plate (2I), forming with the first angle plate the general shape of a U, the two angle plates embracing the adjacent housing of the portable circular saw on at least two sides thereof, thus securing it against rotation.

7. Conversion set according to claim 5, characterized in that the said guide bar (27) is accommodated in an opening (29) in said main bearing plate (28) and secured therein by means of at least one screw (30).

8. Conversion set according to claim 7, characterized in that the at least one screw (30) coacts with an oblong hole to render the said guide bar (27) adjustable (chain tensioner).

9. Conversion set according to claim 5, characterized in that the said cover plate (31) is connected with the said main bearing plate (21) via spacer means (32, 33, 34).

10. Conversion set according to claim 9, including a safety riving knife characterized in that the said spacer means are constituted by a first spacer pin serving at the same time as chain-catcher pin, a second spacer pin sarving at the same time to fasten at least partly said safety riving k fe (35), and a third spacer pin (33).

11. Conversion set according to claim 9, characterized in that the said cover plate (31) carries an oil tank (36) and a tube between said oil tank and said guide bar.

12. Conversion set according to claim 11, and a groove in said main bearing plate, characterized in that the said tube (37) is received in said groove of the said main bearing plate (31).

13. Conversion set according to claim 1, characterized in that the said mounting spindle is proved with an internal flat driving surface, and the said output mounting shaft exhibits a complementary shape, so that the said mounting spindle is secured on the said output mounting shaft to rotate therewith.

* * * * *